United States Patent [19]

Prachel et al.

[11] 4,149,439

[45] Apr. 17, 1979

[54] APPARATUS FOR PREPARING PACKINGS AND THE LIKE

[75] Inventors: Ronald H. Prachel, Salt Lake City, Utah; Donald N. Russell, Williamson; Jerry R. Mitchell, Palmyra, both of N.Y.; Elmer L. Addison, Parma, Ohio

[73] Assignee: Garlock Inc., Rochester, N.Y.

[21] Appl. No.: 877,690

[22] Filed: Feb. 13, 1978

[51] Int. Cl.[2] ..... B26D 7/02; B26D 7/16; B26D 7/28

[52] U.S. Cl. ..... 83/459; 83/452; 83/468; 83/522; 83/609; 83/642; 83/694; 83/700

[58] Field of Search ..... 83/459, 452, 468, 522, 83/443, 642, 658, 694, 609, 907, 460

[56] References Cited

U.S. PATENT DOCUMENTS

| | | | |
|---|---|---|---|
| 1,176,838 | 3/1916 | Landry | 83/642 X |
| 1,540,362 | 6/1925 | Norvell | 83/468 X |
| 1,622,655 | 3/1927 | Long | 83/468 |
| 1,745,815 | 2/1930 | Schoepfle | 83/468 |
| 2,889,877 | 6/1959 | Ralston | 83/468 |
| 3,487,773 | 1/1970 | Meier | 83/468 X |

*Primary Examiner*—Frank T. Yost

*Attorney, Agent, or Firm*—Woodcock, Washburn, Kurtz & Mackiewicz

[57] ABSTRACT

A spiral cutting anvil is provided with indicia along its length, and a series of aligned gaps through which a cutting blade can be passed. A cutting blade comprises the working portion of a cutter assembly pivotally fastened to a slide plate which can be located at various positions with respect to the anvil. An adjustable stop is disposed at an appropriate point along the spiral, as determined by the indicia, and a length of packing material extends from the stop along the anvil to one of the gaps. The cutting blade is then urged through the gap, in guillotine fashion, to sever the packing at the correct point.

12 Claims, 1 Drawing Figure

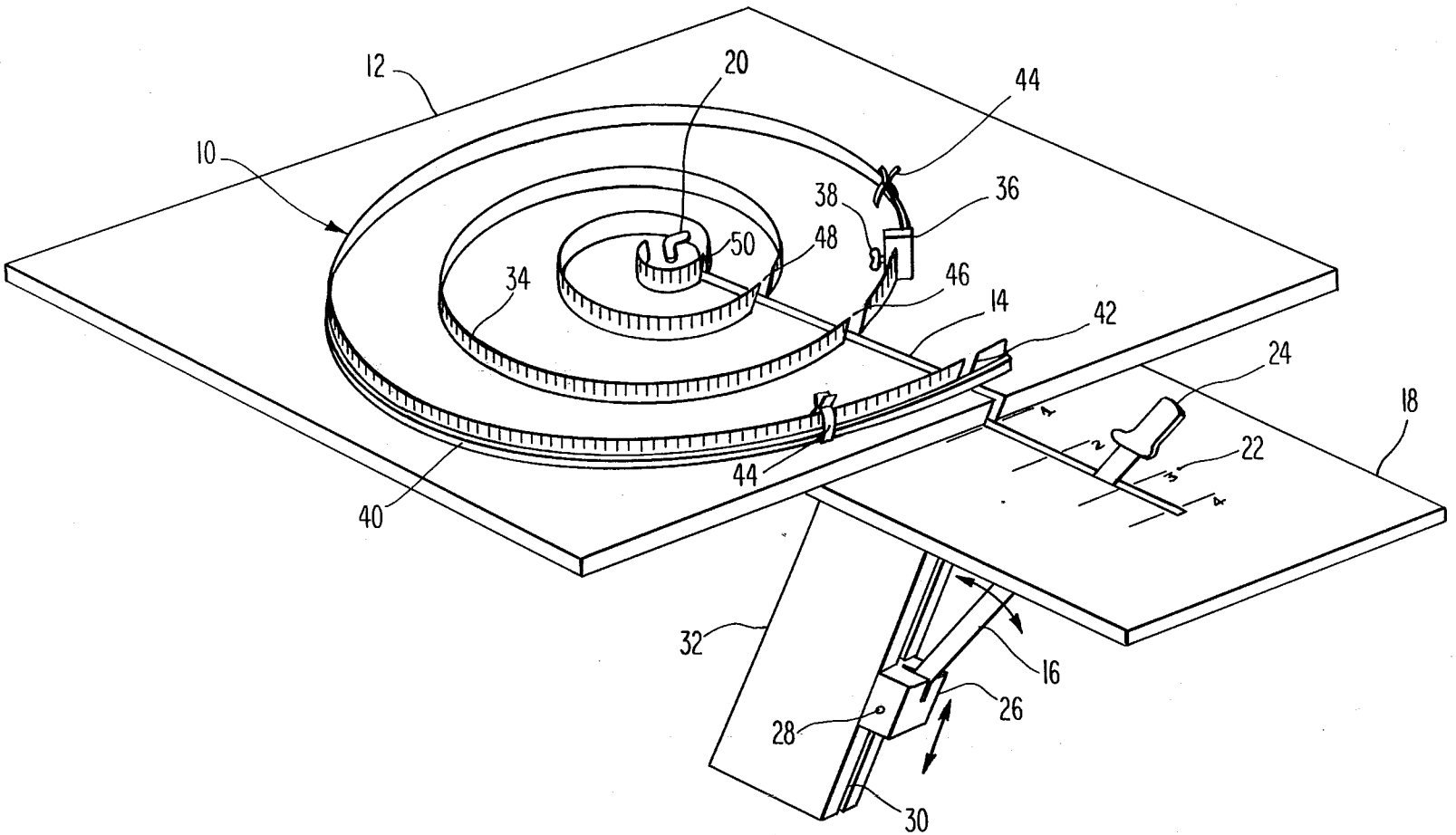
10
12
14
16
18
20
22
24
26
28
30
32
34
36
38
40
42
44
44
46
48
50

APPARATUS FOR PREPARING PACKINGS AND THE LIKE

BACKGROUND OF THE INVENTION

The present invention relates to the preparation of packing materials and the like, and more particularly to an improved cutting assembly for determining the proper length of a packing and severing the same.

In many types of mechanisms it is necessary to provide a seal about an axle, rod, or other shaft-like member. Such seals are commonly held in place by appropriate means surrounding the element, such as glands, stuffing boxes and the like. The seal is constituted by a length of packing material, and is commonly used to prevent the ingress or escape of fluids such as water or hydraulic oil, or to prevent foreign materials such as particulate matter from entering a mechanism. The packing is commonly of a resilient material which must be resistant to attack from the various materials with which it comes in contact. At one time such packings were formed of various fibrous ropes or yarns impregnated with suitable lubricants, binders and other materials, or of strands of metal, such as lead. The packing was simply wrapped about the shaft element and then axially compressed, the compression serving to squeeze the packing tightly about the shaft thereby providing a fluid-tight seal. With modern machinery endless packing rings are often utilized; and many synthetic materials have been developed which exhibit superior sealing characteristics and are moreover highly resistant to the various materials which they encounter.

In some cases, however, it is impossible or inconvenient to use an endless packing ring. The shaft element may, for instance, have enlarged ends or the ends may otherwise be inaccessible so that an endless ring cannot be slipped over them; or, it may be economically impractical to manufacture and store all of the various types and sizes of endless ring packings which could conceivably be required.

For this reason it is commonplace to form ring packings for shafts and the like from a length of stock material by cutting the material to length by various means such as knives, shears, saws and the like. Over the years various types of apparatus have been devised to facilitate the task of calculating and measuring the precise length of the packing which is required. Examples of such devices are disclosed in U.S. Pat. No. 1,745,815-Schoepfle and U.S. Pat. No. 3,487,773-Meier. According to such prior art approaches, the inside and outside diameters of the requisite packing ring were determined and averaged, and this figure used to determine the length of the packing strip which was required. As will be readily recognized, determining the precise length of the packing is critical to the satisfactory operation of the same since too long a packing will be compressed too much in the stuffing box or gland and may engage the moving shaft member too tightly. On the other hand too short a packing will leave an open gap between the confronting ends, which defeats the purpose of the packing by providing an opening adjacent the shaft member.

Calculation and measurement of a packing of the proper length is made difficult by the fact that the ends of the packing are preferably cut on a bias and also since the packing, having a rather substantial width, exhibits a perceptible change in its length as it is bent into a curve. More specifically, when bent the radially inner portions of the packing tend to be compressed, while the radially outermost elements are stretched somewhat. In order to determine the proper length of such packing, a trial-and-error method is often used; or a mandrel or ring of the same diameter as the shaft member is prepared, and the packing wound about the periphery of the ring so that the precise required length can be determined. The deficiencies of this approach are apparent, inasmuch as a packing supplier must prepare and keep on hand a forming ring for each shaft size for which a packing may be required. In addition to the physical problem presented by preparation, handling and storage of these devices, an inordinate amount of time is required for selecting and readying each element for the cutting of a packing.

To further complicate matters, certain of the more recently developed types of packing are formed of elastomeric materials which are extruded and coiled during their manufacture. These packing materials are then transported to users in coiled form. Such preformed packing material has a fixed, standard radius of curvature, so that its effective length changes as it is stretched about a forming element whose radius is either larger or smaller than the preformed radius of the packing material. The resulting distortions in the packing further complicate the task of determining the proper length of packing material for a given shaft size. Either the distortion must be taken into consideration when cutting the packings to length or else individual forming rings must be used, as described above.

From the foregoing, it will be understood that it would be highly desirable to provide a single, compact apparatus for determining the proper length of a segment of packing material and for cutting the packing to the precise length without the need for a multiplicity of forming rings.

It is therefore an object of the present invention to provide an improved apparatus for measuring and cutting packing materials.

Another object of the invention is to provide means for facilitating the measuring and cutting of permanently coiled elastomeric packing materials.

Yet another object is to furnish a single packing forming means which accommodates packings for shaft elements of disparate diameters.

SUMMARY OF THE INVENTION

Briefly stated, in accordance with one aspect of the invention the foregoing objects are achieved by providing a single, spiral anvil having one or more gaps therein which define transverse edges of the anvil, and having indicia associated with it to facilitate the precise placement of a length of packing material with respect to a gap. Cutting means are provided adjacent the gap and movable through the gap to sever the packing at precisely the proper point.

In a preferred embodiment the cutting means comprises a knife or the like; and a stop is adjustably mounted along the anvil to define the end location of a length of packing. One or more clamps are used to clamp the length of packing against the anvil, and the means locating the cutting knife are movable with respect to the anvil to allow the knife to intercept the spiral at any of several points thereon.

BRIEF DESCRIPTION OF THE DRAWING

While the specification concludes with claims particularly pointing out and distinctly claiming the subject matter which is regarded as the invention, it is believed that the invention will be better understood from the following description of a preferred embodiment taken in conjunction with the accompanying drawing in which the single FIGURE depicts apparatus for practicing the invention.

DESCRIPTION OF A PREFERRED EMBODIMENT

In the illustrated embodiment a spiral anvil 10 is fixedly mounted upon a table 12 and describes a number of turns, progressively extending outwardly toward the table periphery. Each turn of the anvil is interrupted by an opening or gap which defines an edge extending across the anvil; and the gaps are aligned along a locus extending radially outwardly from the center of the spiral. A slot 14 extends partway across the table and is aligned with the various anvil gaps so that a single cutting means may pass through the slot and the openings in the anvil.

In the present embodiment the cutting means takes the form of an elongate knife 16 which extends upwardly through a slot in a slide plate 18. The latter plate is located with respect to table 12 by means of guideways or the like (not shown) and can be fixed in a plurality of discrete positions by locating means such as a keeper pin 20 which extends through table 12 and registers in one of a series of mating holes in the slide plate. A number of marks 22 are provided on the slide plate and used to indicate which of the various openings in the anvil can be penetrated by knife 16, the mark registering with the nearest edge of the table indicating the turn of the spiral anvil in which the knife can register.

The uppermost end of knife 16 is surrounded by a handle 24, it being anticipated that in the preferred embodiment of the invention the knife will be manually manipulated. The lowermost end of the knife is pivotally captured in a slider block 26 by means of a pivot pin 28 or the like. The slider block is constrained to slide in a generally upright way 30, which may be a slot in a rigid supporting member 32. With the illustrated construction the knife blade can be moved forwardly to penetrate an opening of a selected turn of the spiral anvil, while being pushed downwardly so as to effect a guillotine-type of cutting action.

Anvil 10 is preferably formed of a thin strip of a strong material such as spring steel. The steel strip is embedded in grooves in the surface of table 12, or otherwise firmly attached thereto by appropriate means such as brackets or the like. Indicia 34 are associated with the spiral anvil along its length for use in determining the location of one end of a packing to be severed. In a preferred embodiment the indicia are placed directly upon the uppermost edge of the anvil; however, it will be appreciated that they could alternatively be located upon the surface of the table. As will be described hereinafter, the spacing and numbering of the indicia can be arbitrary, and may include letters, numbers or other symbols although a numerical scale is preferred.

A stop 36 is adjustably associated with the spiral anvil and may be moved along the anvil to any desired position, then fixedly located there. In one successfully tested embodiment the stop comprised a clamp including a thumb screw 38 by which the clamp can be rigidly positioned at a predetermined point along the anvil, as indicated by the indicia. One end of a length of packing 40 abuts stop 36, and the packing extends along the outer surface of the anvil to the outermost one 42 of the gaps. In order to hold the packing tightly in place against the anvil a plurality of spring-loaded clamps 44 are provided, it being recognized that various other clamping means could alternatively be selected for use with the invention.

The present invention is particularly well adapted for use with elastomeric packing materials which are supplied in a permanently coiled configuration, or for cutting endless packing rings to a new length. Upon first considering the problem it would seem that a predictable stretching or distortion of the packing could only occur if it were bent about a regular form, i.e. a circle. According to prior art methods, unsatisfactory results are obtained when one bends a length of packing about an oversize forming ring and attempts to adjust the length of the packing to suit a different-size application. Since the length of many packings change as a function of their curvature, good prior art practice has dictated that the packing be formed in the proper diameter before being cut to length.

Although the effective length of the coiled packing material changes as the material is either stretched out on an arc of larger radius, or compressed about an arc of smaller radius, it has been found that the correct length of packing can be predicted when it is formed about an arc of decreasing curvature as exemplified by the spiral anvil 10 of the present invention. It has been found that a predictable relationship between the length of the packing when formed against such an anvil and its ultimate length when formed about a shaft of a given diameter can be found through trial and error, or may alternatively be calculated, taking into account various factors such as the thickness of the packing, its elastomeric characteristics, cross-sectional shape, the specific size of the spiral anvil, and the like. The requisite length can then be correlated with the indicia 34 on the anvil. The length of the packing and thus the appropriate location for stop 36 will depend principally upon the diameter of the shaft member which is to be encircled by the packing. In addition, the size, form and physical characteristics of the packing may bear upon the selection of the point at which stop 36 is located.

In order to more closely approximate the precise packing length required, different turns of the spiral anvil may be selected. Accordingly the outermost turn, herein designated position 1, and correlated with position "1" of slide plate 18, may be used for packings for shafts of 14 to 40 inches in diameter; the second (next innermost) turn or position, for shafts where diameters are from 10 to 14 inches; the third position, or next innermost turn, for shafts from 7 to 10 inches in diameter; and so on.

The length of the packing to be cut is not limited to one full turn within the spiral. For instance, clamp 36 may be located upon the second turn of the spiral anvil, radially inwardly of its position as depicted in the FIGURE, and packing 40 wound about the spiral for another 360 degrees so that it crosses the second opening 46 lying in the second turn of the spiral. The packing is then cut to length by urging knife 16 through the first opening 42; it is of course unnecessary (and in some instances undesirable) for the knife to traverse the next aligned opening 46. The length of the packing is thus determined by the distance from stop 36 to the anvil opening through which the knife passes.

In order to make use of the invention the diameter of the shaft member is first ascertained; then a table, generated by trial and error or through calculation, is consulted to determine the appropriate indicia at which stop 36 will be located, the turn of the spiral anvil to be used, and the point (gap) at which the packing is to be severed. In the example depicted in the FIGURE a packing for a relatively large shaft member is to be prepared. Accordingly, stop 36 is stationed at a mark which is spaced at the distance, measured along the spiral anvil from the edge of gap 42, which will produce a packing of the proper length. Packings for shafts of much smaller diameters could possibly be formed by disposing clamp 36 quite close to gap 42, and severing the packing at that opening; however, it has been found to be a better practice to place the stop 36 upon one of the radially smaller, inner turns of the spiral and sever the packing at the gap nearest thereto.

From the illustration it will be seen that slot 14 and knife 16 are canted at an angle with respect to the plane of the spiral, and accordingly to the plane of table 12. This allows the packing to be severed at an appropriate angle, ordinarily 45°, to further facilitate sealing of the abutting ends of the packing when it is disposed about a shaft member. Before being brought into contact with stop 36 the leading end of the packing is prepared by placing it across gap 42, and knife 16 advanced forward and downwardly. In this manner the leading end of the packing is severed at the same angle at which the trailing end will be severed, so that a perfect match of the abutting ends may be achieved.

As set forth above, when a packing is to be formed about one of the inner turns of the spiral the cutting means is advanced toward the center of the spiral. This is effected by withdrawing locating pin 20 and urging table 12 further over slide plate 18. If the packing is to be severed at the gap 46 in the second turn of the spiral, table 12 is advanced until the edge thereof aligns with mark "2" on slide plate 18. Keeper pin 20 is then replaced so that the table and slide plate are firmly locked together. In similar fashion if it is desired to sever the packing at gaps 48 or 50 of the third and fourth turns, respectively, table 12 is advanced until its leading edge registers with lines "3" or "4", as appropriate.

As will be evident from the foregoing description, certain aspects of the invention are not limited to the particular details of the examples illustrated, and it is therefore contemplated that other modifications or applications will occur to those skilled in the art. Anvils with more or less turns than those depicted may be selected for use; and various other cutting means, including for example shear blades, rotating or reciprocating saws, or the like may be utilized in the stead of a knife. Accordingly, it is intended that the appended claims shall cover all such modifications and applications as do not depart from the true spirit and scope of the invention.

What is claimed as new and desired to be secured by Letters Patent of the United States is:

1. Apparatus for cutting packing material to the proper length for forming a packing ring about a shaft of a known diameter, comprising:

spiral anvil means having at least one transverse edge to support a packing to be cut;

indicia associated with said anvil means to allow an end of the packing material to be aligned at a predetermined point along the length of said anvil means; and cutting means operatively associated with said transverse edge of said anvil means to sever the packing material at a predetermined point.

2. Apparatus according to claim 1, further including adjustable means for locating one end of the packing material at a predetermined point along said anvil as determined by said indicia.

3. Apparatus according to claim 2, wherein said adjustable means comprises a stop and clamping means for fastening said stop to said anvil means.

4. Apparatus according to claim 3, further including second clamping means for fixedly holding the packing material adjacent a portion of said anvil means.

5. Apparatus according to claim 4, wherein said second clamping means comprise a plurality of spring-loaded clamps.

6. Apparatus according to claim 2, wherein said anvil means is interrupted at a plurality of points, each of said interruptions comprising a gap defining an edge generally transverse to said anvil means.

7. Apparatus according to claim 6, wherein said gaps are aligned with one another.

8. Apparatus according to claim 7, wherein said cutting means comprises knife means disposed at some angle to the plane of the spiral, said gaps receiving said knife means in close proximity thereto for cutting through packing material disposed adjacent to said anvil means.

9. Apparatus for use in determining the length of a packing needed for encircling a shaft or the like, and for cutting packing material to the length, comprising:

a generally planar table;

a spiral anvil disposed on said table and being interrupted at at least two points along the length thereof, said points being aligned along a radius of the spiral;

indicia formed along a surface of said anvil;

a stop adapted to be adjustably positioned along said spiral at a point determined by said indicia;

said table having a slot extending partway thereacross and aligned with said interruptions of said anvil;

a slide board slidingly engaging said table;

means for locating said slide board at a plurality of positions with respect to said table; and cutting means carried by said slide board and generally aligned with said slot for intercepting said spiral at at least one of the interruptions thereof.

10. Apparatus according to claim 9, further including clamp means for locating a length of packing adjacent said spiral.

11. Apparatus according to claim 10, wherein said slide board and said table comprise means for disposing said cutter means at an angle of substantially 45° with respect to the plane of said table.

12. Apparatus according to claim 11, wherein said cutting means comprises an elongate knife extending upwardly through said slide board and including a handle at the upper end thereof; and means pivotally encapturing the lowermost end of said knife means for constraining said knife means to lie at approximately 45° to the plane of said table.

* * * * *